US006243122B1

(12) United States Patent
Nakamura et al.

(10) Patent No.: US 6,243,122 B1
(45) **Date of Patent: *Jun. 5, 2001**

(54) DIGITAL EXPOSURE APPARATUS

(75) Inventors: Shigetaka Nakamura; Hiromichi Morishima, both of Wakayama (JP)

(73) Assignee: Noritsu Koki Co., Ltd., Wakayama-ken (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/162,712

(22) Filed: Sep. 29, 1998

(30) Foreign Application Priority Data

Sep. 30, 1997 (JP) ..... 9-265492

(51) Int. Cl.[7] ..... B41J 2/47
(52) U.S. Cl. ..... 347/232; 347/122
(58) Field of Search ..... 347/232, 238, 347/115, 120, 121, 122, 130; 355/20, 40, 77, 41; 313/494, 495, 496–7, 306

(56) References Cited

U.S. PATENT DOCUMENTS 4,578,615 3/1986 Genovese ..... 313/497
4,712,909 * 12/1987 Oshikoshi ..... 355/20
4,859,913 8/1989 Genovese ..... 347/122
5,592,205 1/1997 Shimizu ..... 347/115
5,592,206 1/1997 Watanabe ..... 347/122

FOREIGN PATENT DOCUMENTS 0160518 11/1985 (EP) .

OTHER PUBLICATIONS

Patent Abstracts of Japan vol. 096, No. 007, Jul. 31, 1996 & JP 08067027 (Toshiba Corp), Mar. 12, 1996.

* cited by examiner

*Primary Examiner*—N. Le
*Assistant Examiner*—Lamson D. Nguyen
(74) *Attorney, Agent, or Firm*—Fulbright & Jaworski, LLP

(57) ABSTRACT

A vacuum fluorescent print head (60) for photographic printing paper having luminous elements with phosphorous objects (64, 164) arranged linearly in a main scanning direction to form a plurality of luminous element arrays (90, 190) arranged in a sub-scanning direction at right angles to the main scanning direction. The luminous elements (62, 63, 64; 162, 163, 164) of the luminous element arrays (90; 190) are arranged at predetermined intervals, and the luminous element arrays are arranged relative to one another, such that light beams radiating from the luminous elements of one of the luminous element arrays and from the luminous elements of another of luminous element arrays lie close to one another without overlapping in the sub-scanning direction.

1 Claim, 7 Drawing Sheets

DIGITAL EXPOSURE APPARATUS

BACKGROUND OF THE INVENTION

1. Field of the Invention

This invention relates to a vacuum fluorescent print head for printing paper having luminous elements with phosphorous objects which emits light beams to the printing paper based on image data, the luminous elements being arranged zigzag and in a plurality of columns extending in a main scanning direction.

2. Description of the Related Art

A print head for use on a fluorescent printer for forming color images on a photosensitive medium is disclosed in U.S. Pat. No. 5,592,205 (corresponding to Japanese Patent Laying-Open Publication H5-92622), for example. This print head has filamentary electrodes acting as cathodes for releasing thermions, control electrodes, and a plurality of strip-like anode electrodes covered by phosphorous objects of a predetermined size arranged at predetermined intervals, all sealed in a vacuum case. Thermion impingement upon the phosphorous objects, i.e. light emission from the phosphorous objects, is controlled by applying a voltage to the strip-like anode electrodes and applying control signals based on image data to the control electrodes. Each phosphorous object corresponds to one pixel of an image, i.e. one dot. The phosphorous objects must be arranged close to one another to obtain high resolution. However, it is essential that the phosphorous objects are spaced from one another. It is thus necessary to arrange the phosphorous objects zigzag and in a plurality of columns extending in the main scanning direction, such that the intervals between the phosphorous objects in each column are covered by the phosphorous objects in another column.

In the above print head having the phosphorous objects arranged zigzag and in a plurality of columns, the phosphorous objects in one column partially overlap the phosphorous objects in another column in order to avoid gaps occurring, in a sub-scanning direction at right angles to the main scanning direction, between light beam dots formed on the photosensitive medium by the phosphorous objects. Such a print head is effective as a writing head for an electronic copier, for example. However, when used in a digital exposing apparatus for processing photographic printing paper, such a print head causes double exposure where the light beams overlap one another on the printing paper. The overlapping positions have increased density, resulting in stripes due to density variations from dot to dot on the printing paper.

SUMMARY OF THE INVENTION

The object of this invention is to provide a fluorescent print head for printing paper which forms no stripes due to density variations from dot to dot on printing paper even where a print head construction is employed which has luminous elements with phosphorous objects arranged linearly in a plurality of columns extending in a main scanning direction and arranged in a sub-scanning direction at right angles to the main scanning direction.

The above object is fulfilled, according to this invention, by a vacuum fluorescent print head for photographic printing paper having luminous elements with phosphorous objects arranged linearly in a main scanning direction to form a plurality of luminous element arrays arranged in a sub-scanning direction at right angles to the main scanning direction, characterized in that the luminous elements of the luminous element arrays are arranged at predetermined intervals, and the luminous element arrays are arranged relative to one another, such that light beams radiating from the luminous elements of one of the luminous element arrays and from the luminous elements of another of luminous element arrays lie close to one another without overlapping in the sub-scanning direction.

This construction effectively avoids a situation where adjacent dots formed on printing paper are double-exposed by adjacent luminous elements. Preferably, an adjacent pair of dots formed on the printing paper by the luminous elements of the plurality of luminous element arrays have a gap of approximately 0.1 to 0.3 $\mu$m formed therebetween, even where, for example, resolution is approximately 200 dpi, i.e. each dot has a width of approximately 0.12 mm. This suppresses double exposure and achieves prints with no noticeable stripes due to density variations. White color in an image on printing paper is far less conspicuous to the eye than black color. In view of this fact, the above feature is achieved by utilizing the exposure characteristic of printing paper that weakly exposed areas come out in white color.

To obtain light beams as noted above, one preferred embodiment of this invention provides a vacuum fluorescent print head for photographic printing paper comprising a translucent substrate, a first strip-like anode conductor and a second strip-like anode conductor formed on an inner surface of the substrate to extend parallel to a main scanning direction, phosphorous objects covering a plurality of through-holes formed in both of the strip-like anode conductors, control electrodes and filamentary cathodes spaced from the phosphorous objects, and color filters and lenses arranged on an outer surface of the substrate and opposed to the phosphorous objects, wherein the through-holes of the first strip-like anode conductor and the through-holes of the second strip-like anode conductor are arranged zigzag, and close to one another without overlapping in a sub-scanning direction at right angles to the main scanning direction. With this construction, the light beams radiating from the phosphorous objects as a result of impingement thereon of thermions travel through the through-holes, color filters and lenses to the printing paper. The above characteristic arrangement of through-holes effectively avoids overlapping of light beam dots, thereby to produce photographic prints appealing to the eye.

In a different embodiment of the invention, a vacuum fluorescent print head for photographic printing paper comprises a shielding member, filamentary cathodes arranged inwardly of the shielding member, phosphorous objects arranged on an inner surface of the shielding member and covering a plurality of through-holes formed in the shielding member, and color filters and lenses arranged on an outer surface of the shielding member to cover the through-holes, wherein the through-holes are arranged zigzag to extend in a main scanning direction and to lie close to one another without overlapping in a sub-scanning direction at right angles to the main scanning direction. With this construction also, the light beams radiating from the phosphorous objects and traveling through the through-holes, color filters and lenses to the printing paper form dots not overlapping one another, to produce photographic prints appealing to the eye.

In each of the above embodiments, the through-holes arranged zigzag, preferably, have a gap of approximately 0.1 to 0.3 $\mu$m formed therebetween in the sub-scanning direction.

Other features and advantages of this invention will be apparent from the following description of the embodiments to be taken with reference to the drawings.

BRIEF DESCRIPTION OF THE DRAWINGS

FIG. 5 is a schematic plan view of a paper mask and a mechanism for reciprocating the fluorescent print head;

DESCRIPTION OF THE PREFERRED EMBODIMENTS

Figure 1:
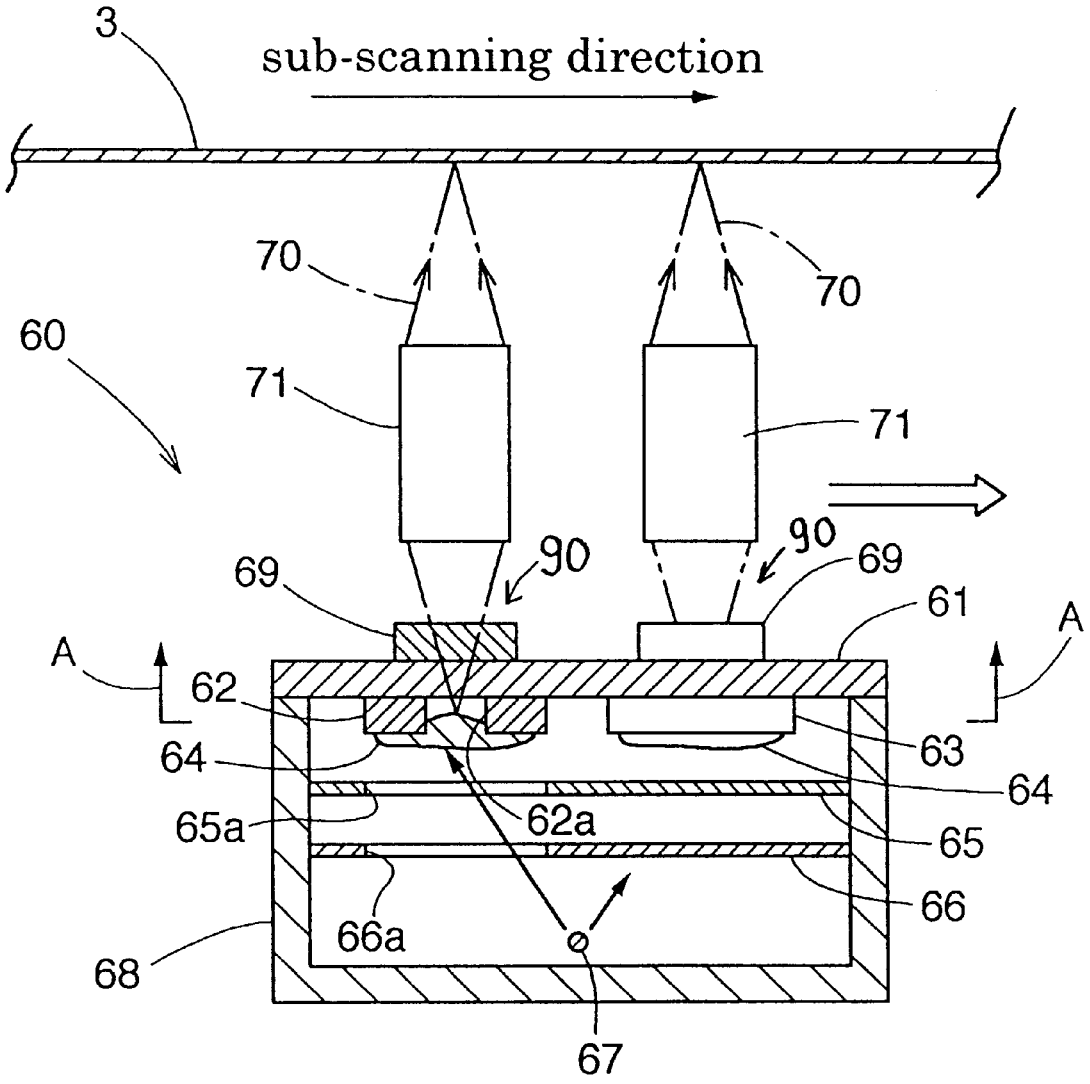
FIG. 1 is a schematic sectional view of a fluorescent print head in one embodiment of this invention.

FIG. 1 shows a schematic sectional view of a fluorescent color print head 60. The print head 60 actually includes three luminous blocks R (red), G (green) and B (blue). However, only the luminous block R is shown in FIG. 1. The other two luminous blocks are similar in construction to the luminous block R.

Figure 2:
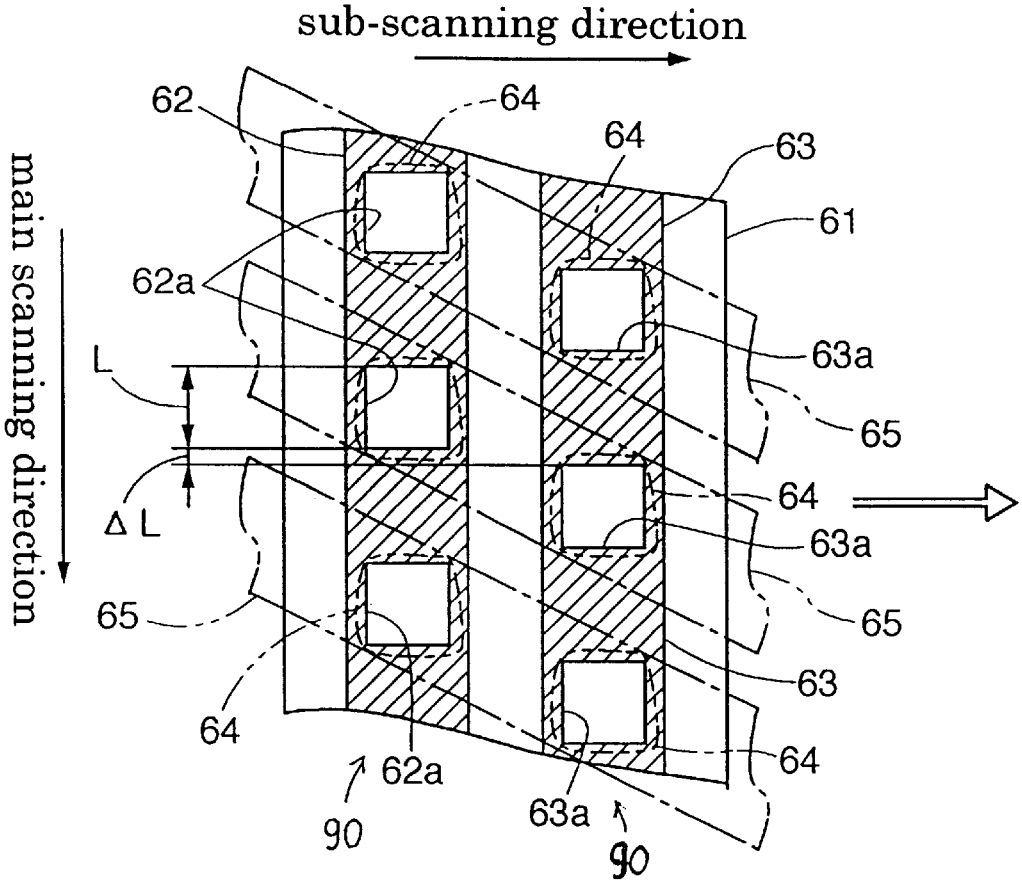
FIG. 2 is an enlarged plan view seen in the direction indicated by arrows A of FIG. 1.
Figure 3:
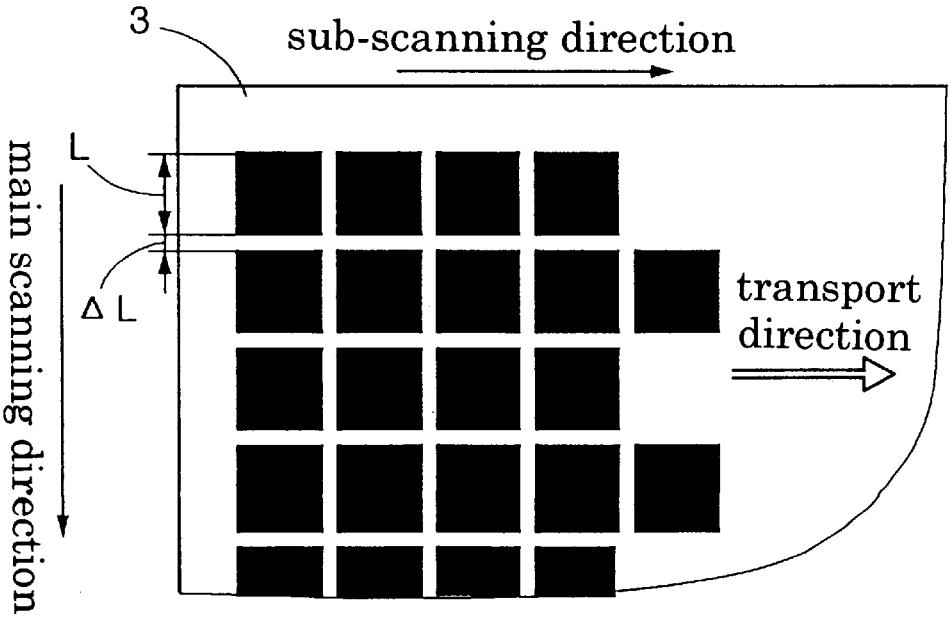
FIG. 3 is an explanatory view of dots exposed by the fluorescent print head according to this invention.

A translucent substrate 61 has, on an inner surface thereof, a first strip-like anode conductor 62 and a second strip-like anode conductor 63 formed of aluminum thin film. As seen from FIG. 2, the strip-like anode conductors 62 and 63 extend in a main scanning direction at right angles to a transport direction of photographic printing paper 3 exposed by the fluorescent print head 60. The anode conductors 62 and 63 define rectangular through-holes 62*a* and 63*a* arranged at predetermined intervals, respectively. The interval between each adjacent pair of through-holes 62*a* or 63*a* is slightly larger than the length of each through-hole 62*a* or 63*a*. In this embodiment, the fluorescent print head 60 has a resolution of approximately 200 dpi, each through-hole 62*a* or 63*a* has a length: L of approximately 0.12 mm, and the distance between an end of each through-hole 62*a* or 63*a* and the corresponding end of an adjacent through-hole 62*a* or 63*a* is 0.24 mm plus about 0.2 to 0.61 $\mu$m. That is, as shown in FIG. 2, the through-holes 62*a* in the first strip-like anode conductor 62 and through-holes 63*a* in the second strip-like anode conductor 63 are arranged zigzag with slight gaps: $\Delta L$=0.1 to 0.3 $\mu$m, without overlapping one another in a sub-scanning direction at right angles to the main scanning direction. Consequently, as shown in FIG. 3, exposure dots are formed at intervals of 0.1 to 0.3 $\mu$m on the printing paper 3.

Each through-hole 62*a* or 63*a* is covered with a phosphorous object 64. The phosphorous object 64 and part of the first strip-like anode conductor 62 or second strip-like anode conductor 63 constitute a luminous element. A plurality of control electrodes 65 are arranged as spaced from the luminous elements and extending in a direction traversing the main scanning direction to constitute a grid in a corresponding relationship to the phosphorous objects 64. The control electrodes 65 have slits 65a formed in areas thereof opposed to the phosphorous objects 64 to act as translucent sections. The control electrodes 65 are electrically independent of one another, and separate control voltages are applied thereto. Further, an accelerating electrode 66 is disposed as spaced from the control electrodes 65. This accelerating electrode 66 consists of a single metal plate defining slits 66*a* corresponding to the slits 65*a* of control electrodes 65. A common accelerating voltage is applied to the electrode 66. Further away from the control electrodes 65 is a filamentary cathode 67 extending in the main scanning direction. The phosphorous objects 64 arranged in one column extending in the main scanning direction (vertical direction in FIG. 2), namely a group of luminous elements, are called a luminous element array 90. Thus, two luminous element arrays 90 are arranged in the sub-scanning direction (horizontal direction in FIG. 2).

The above strip-like anode conductors 62 and 63, control electrodes 65, accelerating electrode 66 and filamentary cathode 67 are 10 enclosed in a vacuum space defined by the inner surface of substrate 61 and a covering 68. The substrate 61 has red filters 69 mounted on an outer surface thereof and opposed to the phosphorous objects 64 to act as color filters. Light beams 70 radiating from the phosphorous objects 64 are adjusted by the red filters 69 and caused by SELFOC lenses 71 to converge on the printing paper 3.

With a predetermined voltage applied to the filamentary cathode 67 and accelerating electrode 66, a voltage is applied alternately to the first strip-like anode conductor 62 and second strip-like anode conductor 63, with predetermined timing of the alternation. Synchronously with the timing of alternation, a positive exposing signal is applied to selected control electrodes 65. As a result, thermions radiating from the filamentary cathode 67 pass through slits 65a according to the states of control electrodes 65, and impinge upon the phosphorous objects 64. The phosphorous objects 64 upon which the thermions impinge emit light beams. These light beams 70 travel through the through-holes to reach the printing paper 3, thereby to expose the printing paper in units of light beam dots. When, for example, all the phosphorous objects 64 emit light, the print head having the above construction exposes the printing paper 3 such that, as shown in FIG. 3, adjacent light beam dots do not overlap one another.

A printer/processor employing the fluorescent print head 60 according to this invention as a principal component of a digital exposing device will be described hereinafter.

Figure 4:
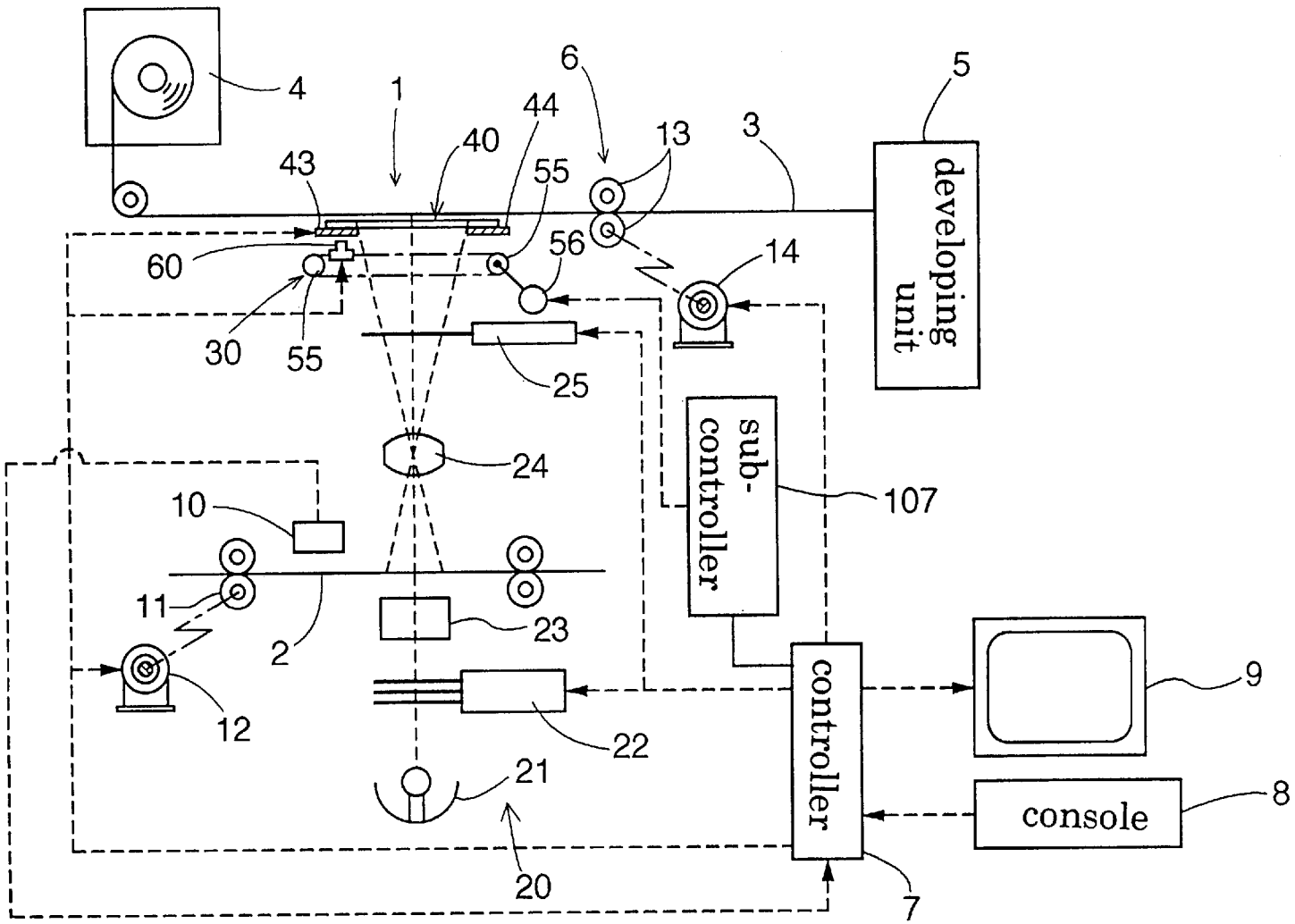
FIG. 4 is a schematic block diagram of a printer/processor employing the fluorescent print head according to this invention.

As seen from the schematic block diagram shown in FIG. 4, the printer/processor includes an optical exposing device 20 for projecting images of photographic film 2 to printing paper 3 acting as a photosensitive material, at an exposing point 1, a digital exposing device 30 for forming images on the printing paper 3 based on digital image data at the same exposing point 1, a developing unit 5 for developing the printing paper 3 exposed at the exposing point 1, a printing paper transport mechanism 6 for transporting the printing paper 3 from a paper magazine 4 through the exposing point 1 to the developing unit 5, and a controller 7 for controlling the components of the printer/processor 1. A paper mask 40 is disposed at the exposing point 1 for determining an area of printing paper 3 to be exposed by the optical exposing device 20. The controller 7 has, connected thereto, a console 8 for inputting various information, and a monitor 9 for displaying pictures and characters. The controller 7 has also a sub-controller 107 connected for communication therewith to perform ancillary functions.

The printing paper 3 drawn out of the paper magazine 4 storing the printing paper 3 in a roll is exposed by the optical exposing device 20 and/or digital exposing device 30, thereafter developed by the developing unit 5, and discharged as cut to a size including a frame of image information. It is of course possible to employ a construction for cutting the printing paper 3 to necessary lengths before exposure.

Each component will be described hereinafter.

The optical exposing device 20 includes a light source 21 for optical exposure in the form of a halogen lamp, a light adjustment filter 22 for adjusting a color balance of light for irradiating the film 2, a mirror tunnel 23 for uniformly mixing the colors of the light emerging from the light adjustment filter 22, a printing lens 24 for forming images of film 2 on the printing paper 3, and a shutter 25, all arranged on the same optical axis providing an exposure optical path.

The images formed on the film 2 are read by a scanner 10 disposed on a film transport path upstream of the optical exposing device 20. The scanner 10 irradiates the film 2 with white light, separates the light reflected from or transmitted through the film 2 into three primary colors of red, green and blue, and measures the density of the images with a CCD line sensor or CCD image sensor. The image information read by the scanner 10 is transmitted to the controller 7 for use in displaying, on the monitor 9, a simulation of each image to be formed on the printing paper 3.

Figure 5:
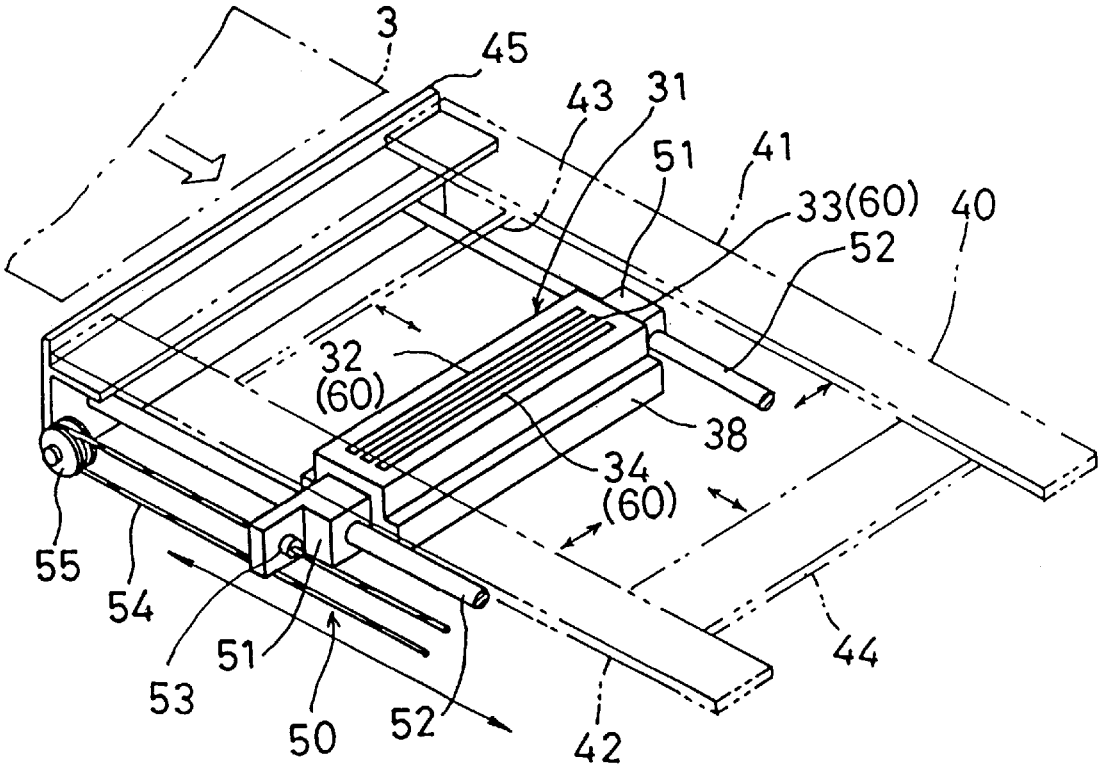
FIG. 5 is a schematic perspective view of a portion of the printer/processor including the fluorescent print head.

As shown in detail in FIG. 5, the digital exposing device 30 includes the fluorescent print head 60 having the R luminous block 32, G luminous block 33 and B luminous block 32 having the construction described hereinbefore, and a reciprocating mechanism 50 for moving the fluorescent print head 60 in the transport direction of printing paper 3. Each luminous block of fluorescent print head 60 is connected to the controller 7. The reciprocating mechanism 50 has a drive system thereof connected to the sub-controller 107. Image data and character data are printed in color on the printing paper 3 based on control of the phosphorous objects 64 by the controller 7 and scan control in the sub-scanning direction of the fluorescent print head 60 by the sub-controller 107 effected through the reciprocating mechanism 50.

Figure 6:
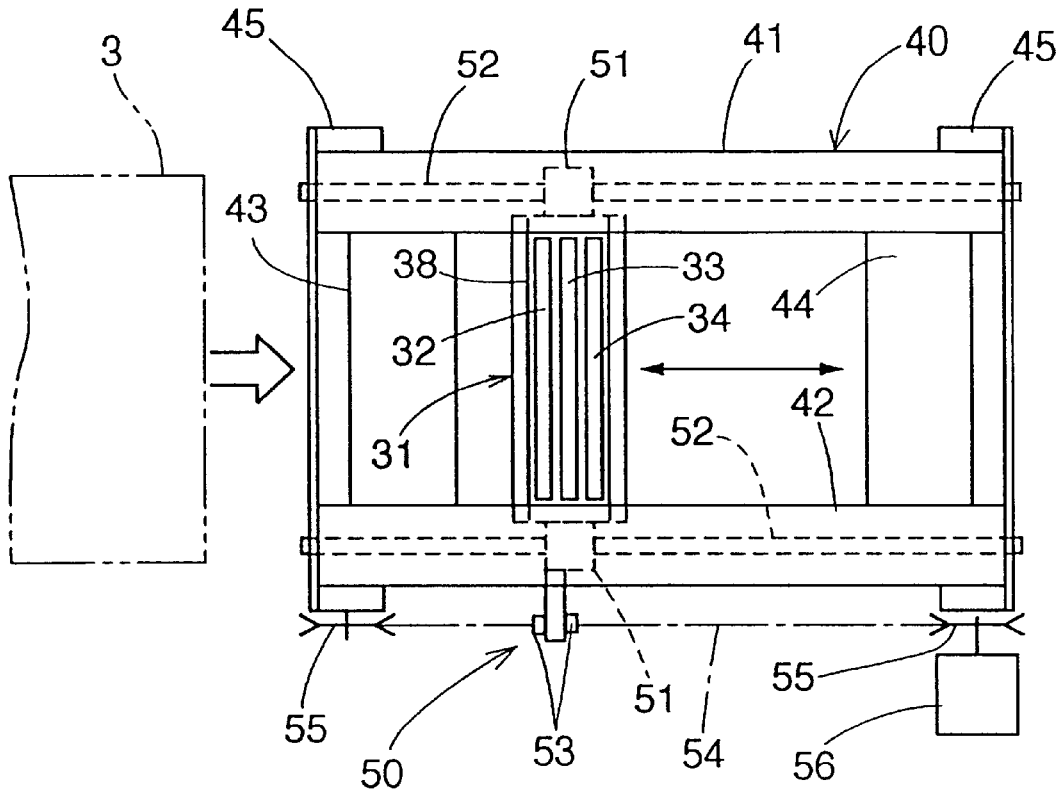
Figure 7:
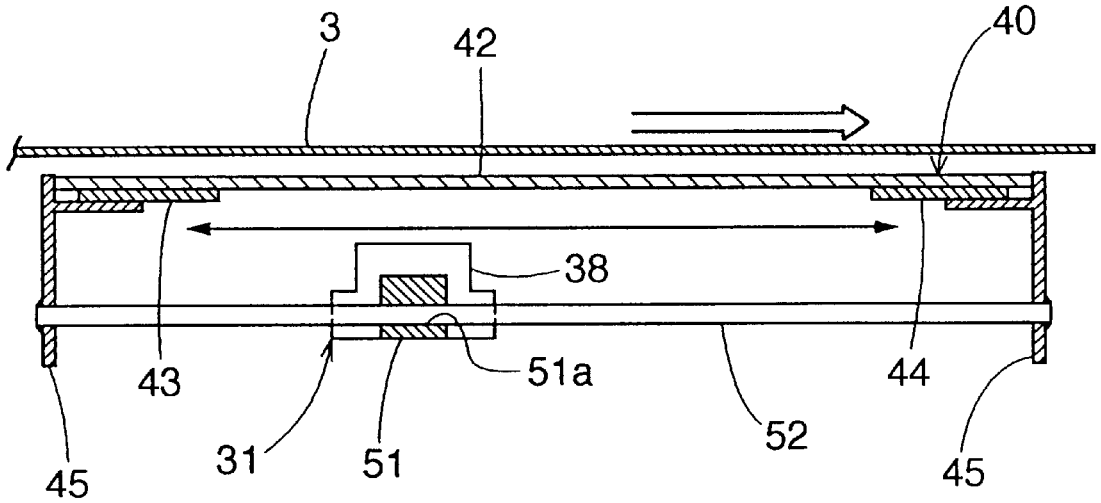
FIG. 7 is a schematic side view of the paper mask and the mechanism for reciprocating the fluorescent print head.

The paper mask 40 is known per se and will not particularly be described. As schematically shown in FIGS. 6 and 7, the paper mask 40 includes an upper frame member 41 and a lower frame member 42 extending parallel to the transport direction of printing paper 3 and reciprocable transversely of the transport direction, a left frame member 43 and a right member 44 extending transversely of the transport direction of printing paper 3 and reciprocable in the transport direction, and a base frame 45 for supporting these members. A distance between the upper frame member 41 and lower frame member 42 determines an exposing range transversely of the printing paper 3. A distance between the left frame member 43 and right member 44 determines an exposing range longitudinally of the printing paper 3. The upper frame member 41, lower frame member 42, left frame member 43 and right member 44 are movable by a drive mechanism not shown, under control or the controller 7.

The reciprocating mechanism 50 for moving the fluorescent print head 60 is attached to the base frame 45 of paper mask 40. The reciprocating mechanism 50 basically includes guide members 51 attached to opposite sides of fluorescent print head 60, guide rails 52 extending through guide bores 51*a* formed in the guide members 51, a wire clamp 53 attached to one of the guide members 51, a wire 54 secured at one end thereof to the wire clamp 53, sprockets 55 arranged at opposite ends of the base frame 45 and having the wire 54 wound therearound, and a pulse motor 56 for rotating one of the sprockets 55 under control of the sub-controller 107. Rotation of the pulse motor 56 causes the fluorescent print head 60 through the wire 54 to move along the guide rails 52.

Figure 8:
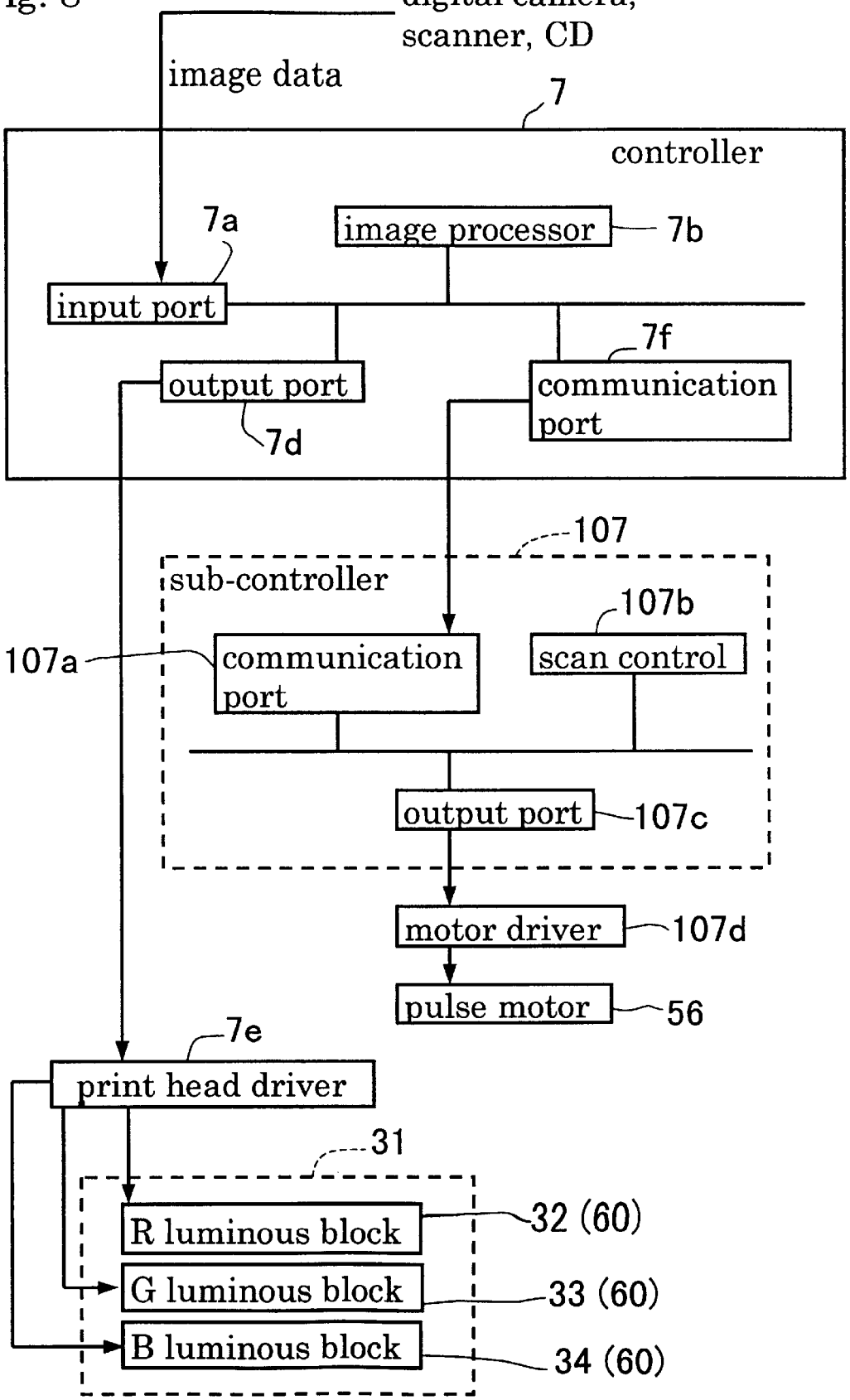
FIG. 8 a block diagram illustrating a digital exposure control using the fluorescent print head.

FIG. 8 is a block diagram schematically showing controls of the fluorescent print head 60 for exposing the printing paper 3. The controller 7 includes an image data input port 7a connected to a device such as a digital camera, scanner or CD to acquire digital images, an image processor 7*b* for processing, as necessary, image data inputted or digitized character data and converting these data into printing data for output to the fluorescent print head 60, and an output port 7*d* for outputting various data to external devices. The printing data noted above is transmitted through a print head driver 7*e* to R luminous block 32, G luminous block 33 and B luminous block 34 of fluorescent print head 60. The controller 7 further includes a communication port 7*f* connected to a communication port 107*a* of sub-controller 107. The sub-controller 107 includes a scan control 107*b* for generating control signals relating to scanning speed and timing of fluorescent print head 60. The sub-controller 107 cooperates with the controller 7 to transmit a control signal to the pulse motor 56 through an output port 107*c* and a motor driver 107*d*. With this cooperation of controller 7 and sub-controller 107, an image is printed by the fluorescent print head 60 in a predetermined position of printing paper 3.

An outline of operation of the printer/processor will be described next.

When a film 2 is fed to the optical exposing device 20 by rollers 11 driven by a motor 12, the controller 7 controls the light adjustment filter 22 based on the image information of film 2 read by the scanner 10. As a result, the irradiating light from the light source 21 is adjusted to a color balance corresponding to color density of an image on the film 2. The optical exposing device 20 irradiates the film 2 with the adjusted light. The image information of the film 2 is projected as transmitted light to the printing paper 3 located at the exposing point 1, to print the image of film 2 on the printing paper 3. The fluorescent print head 60 of digital exposing device 30 is operated, as necessary, to print additional characters and an illustration such as a logo mark in a peripheral position of an area printed by the optical exposing device 20. When an image photographed with a digital camera is printed on the printing paper 3, only the digital exposing device 30 is operated to print the image on the printing paper 3 located at the exposing point 1.

The printing paper 3 having an image printed thereon at the exposing point 1 is transported to the developing unit 5 by the paper transport mechanism 6 having a plurality of rollers 13 and a motor 14 controllable by the controller 7 to drive these rollers 13. The printing paper 3 is developed by being passed successively through a plurality of tanks storing treating solutions for development. This paper transport mechanism 6 functions also to stop the printing paper 3 drawn out of the paper magazine 4 in a predetermined position at the exposing point 1. Thus, where a mode is employed to continue transporting the exposed printing paper 3 to the developing unit 5, the paper transport mechanism 6 may be divided at the exposing point 1 into an upstream portion and a downstream portion with respect to the transport direction, and driven independently of each other.

In the above embodiment, the fluorescent print head 60 is movable over the printing paper 3 to expose a predetermined area of printing paper 3. Alternatively, the fluorescent print head 60 may be fixed to a predetermined position at the exposing point 1, with the printing paper 3 moved to expose only a predetermined area thereof In this case, the printing paper 3 may be moved by operating the paper transport mechanism 6 based on a control signal from the controller 7.

A fluorescent print head 60 in a different embodiment of this invention will be described hereinafter with reference to FIGS. 9 and 10.

Figure 9:
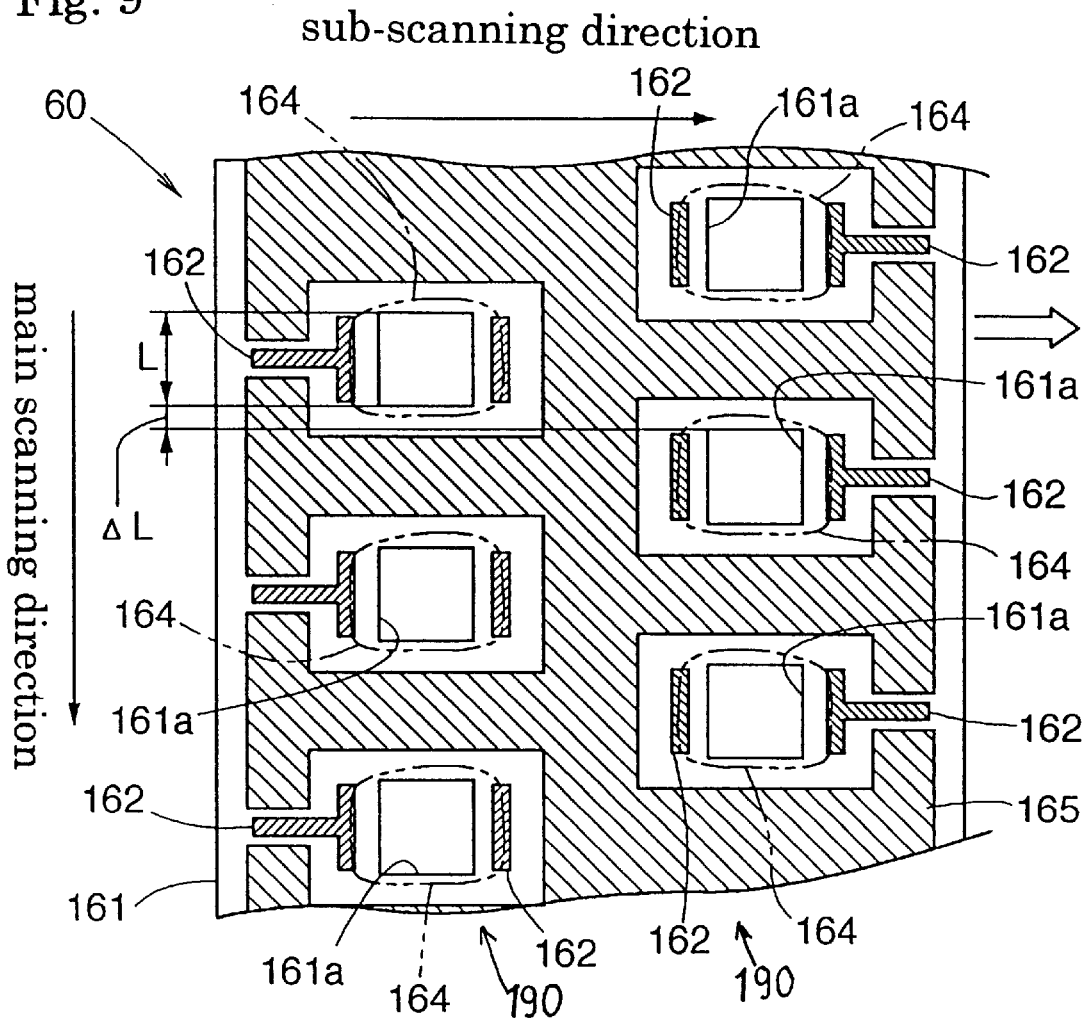
FIG. 9 is a schematic plan view of a fluorescent print head in a different embodiment of this invention.
Figure 10:
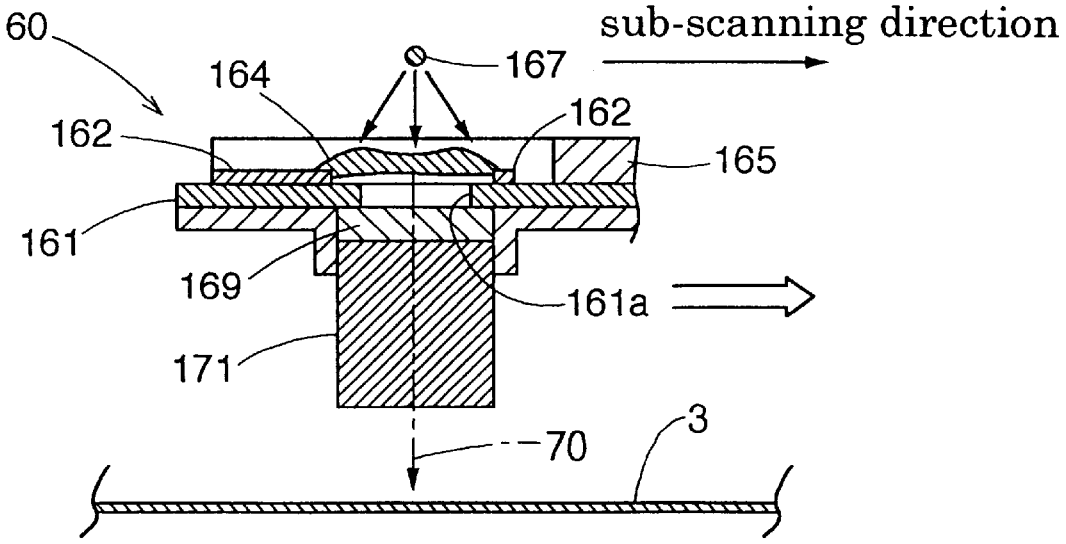
FIG. 10 is a schematic sectional view of the fluorescent print head in the different embodiment.

FIG. 9 shows only part of a luminous block R of the fluorescent print head 60. FIG. 10 shows a component of the luminous block for producing one light beam dot.

A shielding substrate 161 acting as a shielding mask defines rectangular through-holes 161*a* arranged at predetermined intervals and in two columns extending in a main scanning direction. In this embodiment also, the interval between each adjacent pair of through-holes 161*a* in each column is slightly larger than the length of each through-hole 161*a*. That is, each through-hole 161*a* has a length: L of approximately 0.12 mm, and the distance between an end of each through-hole 161*a* and the corresponding end of an adjacent through-hole 161*a* in each column is 0.24 mm plus about 0.2 to 0.6 $\mu$m. The through-holes 161*a* are arranged zigzag with slight gaps: $\Delta L$=0.1 to 0.3 $\mu$m, without overlapping one another in a sub-scanning direction. Consequently, exposure dots are formed with a resolution of approximately 200 dpi, A pair of anodes 162 formed of aluminum thin film are disposed opposite each other across each through-hole 161*a* in the sub-scanning direction. A phosphorous object 164 extends between the pair of anodes 162 to cover the through-hole 161*a*.

The pair of anodes 162 and the phosphorous object 164 constitute a luminous element. A grid electrode 165 is formed around the luminous elements to prevent crosstalk between the luminous elements. Spaced from the luminous elements are filamentary cathodes 167 extending in the main scanning direction.

The phosphorous objects 164 arranged in one column in the main scanning direction (vertical direction in FIG. 9), namely a group of luminous elements, are called a luminous element array 190. Thus, in this embodiment also, two luminous element arrays 190 are arranged in the sub-scanning direction (horizontal direction in FIG. 9).

The above luminous elements, grid electrode 165 and filamentary cathodes 167 are enclosed in a vacuum space defined by an inner surface of shielding substrate 161 and a covering not shown. The shielding substrate 161 has red filters 169 mounted on an outer surface thereof and opposed to the luminous elements to act as color filters. Light beams 70 radiating from the phosphorous objects 164 are adjusted by the red filters 169 and caused by SELFOC lenses 171 to converge on printing paper 3.

With a predetermined voltage applied to the filamentary cathode 167, a drive voltage corresponding to an exposing signal is applied to the anodes 162 of appropriate luminous elements. As a result, thermions radiating from the filamentary cathodes 167 impinge upon the phosphorous objects 164 of these luminous elements. The phosphorous objects 164 upon which the thermions impinge emit light beams. These light beams 70 travel through the through-holes 161*a* to reach the printing paper 3, thereby to expose the printing paper 3 in units of light beam dots.

When all the phosphorous objects 164 emit light, the print head having the above construction exposes the printing paper 3 such that, as shown in FIG. 3, adjacent light beam dots do not overlap one another.

In the foregoing embodiments, the phosphorous objects 64 or 164 are arranged zigzag and in two columns. It is of course also possible within the scope of this invention to make a zigzag arrangement with three, four or more columns. An important point of this invention is to provide a print head construction for producing light beam dots such that adjacent dots do not overlap one another.

What is claimed is:

1. A digital exposure apparatus comprising;

a vacuum fluorescent print head for photographic printing paper having luminous elements with phosphorous objects arranged linearly in a main scanning direction to form a plurality of luminous element arrays arranged in a sub-scanning direction at right angles to the main scanning direction, said luminous elements of the respective adjacent luminous element arrays being offset relative to one another in said main scanning direction; and a transport mechanism for moving one of said vacuum fluorescent print head and said photographic printing paper relative to the other in said sub-scanning direction;

wherein said luminous elements of said luminous element arrays are arranged at predetermined intervals, and said luminous element arrays are arranged relative to one another such that respective adjacent light beams radiating from said luminous elements of one of said luminous element arrays and from said luminous elements of another of said luminous element arrays lie close to and gapped from one another, without overlapping, in said sub-scanning direction; and a controller for controlling said transport mechanism such that dots of beams formed on the printing paper by the light beams irradiated from said luminous elements of said luminous element arrays are gapped from one another in said sub-scanning direction.

* * * * *

UNITED STATES PATENT AND TRADEMARK OFFICE

CERTIFICATE OF CORRECTION

PATENT NO. : 6,243,122 B1
DATED : June 5, 2001
INVENTOR(S) : Shigetaka et al.

It is certified that error appears in the above-identified patent and that said Letters Patent is hereby corrected as shown below:

Column 3,
Line 51, change "0.61" to -- .6 --.

Signed and Sealed this

Twenty-second Day of January, 2002

*Attest:*

*Attesting Officer*

JAMES E. ROGAN
*Director of the United States Patent and Trademark Office*